US012607073B2

(12) United States Patent
Sauvageau et al.

(10) Patent No.: US 12,607,073 B2
(45) Date of Patent: Apr. 21, 2026

(54) DRILL BITS FOR DRILLING SUBTERRANEAN BOREHOLES AND MECHANICALLY LOCKED CUTTER ELEMENTS FOR SAME

(71) Applicant: National Oilwell Varco, L.P., Houston, TX (US)

(72) Inventors: Richard J. Sauvageau, Conroe, TX (US); Richard Rivera, Jr., Conroe, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/980,749

(22) Filed: Dec. 13, 2024

(65) Prior Publication Data

US 2025/0198240 A1 Jun. 19, 2025

Related U.S. Application Data

(60) Provisional application No. 63/610,298, filed on Dec. 14, 2023.

(51) Int. Cl.
*E21B 10/567* (2006.01)

(52) U.S. Cl.
CPC ..... *E21B 10/567* (2013.01)

(58) Field of Classification Search
CPC ..... E21B 10/567; E21B 10/46
See application file for complete search history.

(56) References Cited

U.S. PATENT DOCUMENTS

| | | | | |
|---|---|---|---|---|
| 10,724,304 | B2 | 7/2020 | Bomidi et al. | |
| 2009/0020339 | A1 | 1/2009 | Sherwood | |
| 2010/0314176 | A1 | 12/2010 | Zhang et al. | |
| 2012/0132471 | A1 | 5/2012 | Zhang et al. | |
| 2019/0145182 | A1 * | 5/2019 | Bomidi | E21B 10/633 175/432 |

FOREIGN PATENT DOCUMENTS

| | | | | |
|---|---|---|---|---|
| CA | 2903635 | A1 | 3/2016 | |
| WO | WO-2014031263 | A1 * | 2/2014 | E21B 10/573 |
| WO | 2016/081807 | A1 | 5/2016 | |

OTHER PUBLICATIONS

PCT/US2024/060118 International Search Report and Written Opinion dated Feb. 18, 2025 (12 p.).

* cited by examiner

*Primary Examiner* — Caroline N Butcher
(74) *Attorney, Agent, or Firm* — CONLEY ROSE, P.C.

(57) ABSTRACT

A cutter element assembly for a fixed cutter drill bit includes a cutter element carrier having a central axis, a first end, a second end opposite the first end, and a receptacle extending axially from the first end. The cutter element assembly also includes a cutter element having a central axis, a first end, and a second end opposite the first end of the cutter element. The cutter element includes a substrate and a cutting layer fixably attached to the substrate. The substrate includes a shaft extending from the second end of the cutter element and a head. The cutting layer is fixably attached to the head. The shaft of the substrate is slidingly disposed in the receptacle with the head seated against the first end of the cutter element carrier. The cutter element is axially locked and rotationally locked relative to the cutter element carrier.

22 Claims, 8 Drawing Sheets

DRILL BITS FOR DRILLING SUBTERRANEAN BOREHOLES AND MECHANICALLY LOCKED CUTTER ELEMENTS FOR SAME

CROSS-REFERENCE TO RELATED APPLICATIONS

This application claims benefit of U.S. provisional patent application Ser. No. 63/610,298 filed Dec. 14, 2023, and entitled "Drill Bits for Drilling Subterranean Boreholes and Mechanically Locked Cutter Elements for Same," which is hereby incorporated herein by reference in its entirety for all purposes.

STATEMENT REGARDING FEDERALLY SPONSORED RESEARCH OR DEVELOPMENT

Not applicable.

FIELD

The present disclosure relates generally to earth-boring bits used to drill a borehole for the ultimate recovery of oil, gas or minerals. More particularly, the present disclosure relates to fixed cutter drill bits with mechanically locked cutter elements.

BACKGROUND

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created has a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about a bit face. The blades generally project radially outward along the bit face and form flow channels therebetween. Cutter elements are typically grouped and mounted on the blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element includes an elongate and generally cylindrical support member that is received and secured in a pocket formed in the surface of one of the several blades via brazing. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate), as well as mixtures or combinations of these materials. The cutting layer is mounted to one end of the corresponding support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the passageways between the several blades. The drilling fluid exiting the face of the bit through nozzles or ports performs several functions. In particular, the fluid removes formation cuttings (for example, rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life.

BRIEF SUMMARY OF THE DISCLOSURE

Embodiments of cutter element assemblies for fixed cutter drill bits are disclosed herein. In one embodiment, a cutter element assembly for a fixed cutter drill bit comprises a cutter element carrier configured to be fixably attached to a cutter-supporting surface of a blade of the fixed cutter drill bit. The cutter element carrier has a central axis, a first end, a second end opposite the first end, and a receptacle extending axially from the first end. The cutter element assembly also comprises a cutter element having a central axis coaxially aligned with the central axis of the cutter element carrier, a first end, and a second end opposite the first end of the cutter element. The cutter element includes a substrate and a cutting layer fixably attached to the substrate. The substrate includes a shaft extending from the second end of the cutter element and a head. The cutting layer is fixably attached to the head and is disposed at the first end of the cutter element. The shaft of the substrate is slidingly disposed in the receptacle with the head seated against the first end of the cutter element carrier. The cutter element is axially locked relative to the cutter element carrier such that the cutter element is prevented from moving axially relative to the cutter element carrier. The cutter element is rotationally locked relative to the cutter element carrier such that the cutter element is prevented from rotating about the central axis of the cutter element relative to the cutter element carrier Embodiments of methods for mounting a cutter element to a blade of a fixed cutter drill bit are disclosed herein. The cutter elements have a central axis and including a substrate and a cutting layer mounted to the substrate. In one embodiment, a method for mounting a cutter element to a blade of a fixed cutter drill bit the method comprises (a) axially inserting a shaft of the substrate into a receptacle of a cutter element carrier fixably mounted to the blade. In addition, the method comprises (b) axially locking the cutter element to the cutter element carrier during (a) such that the cutter element is restricted from moving axially relative to the cutter element carrier. Further, the method comprises (c) rotationally locking the substrate relative to the cutter element carrier during (a) such that the cutter element is prevented from rotating about a central axis of the cutter element relative to the cutter element carrier.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
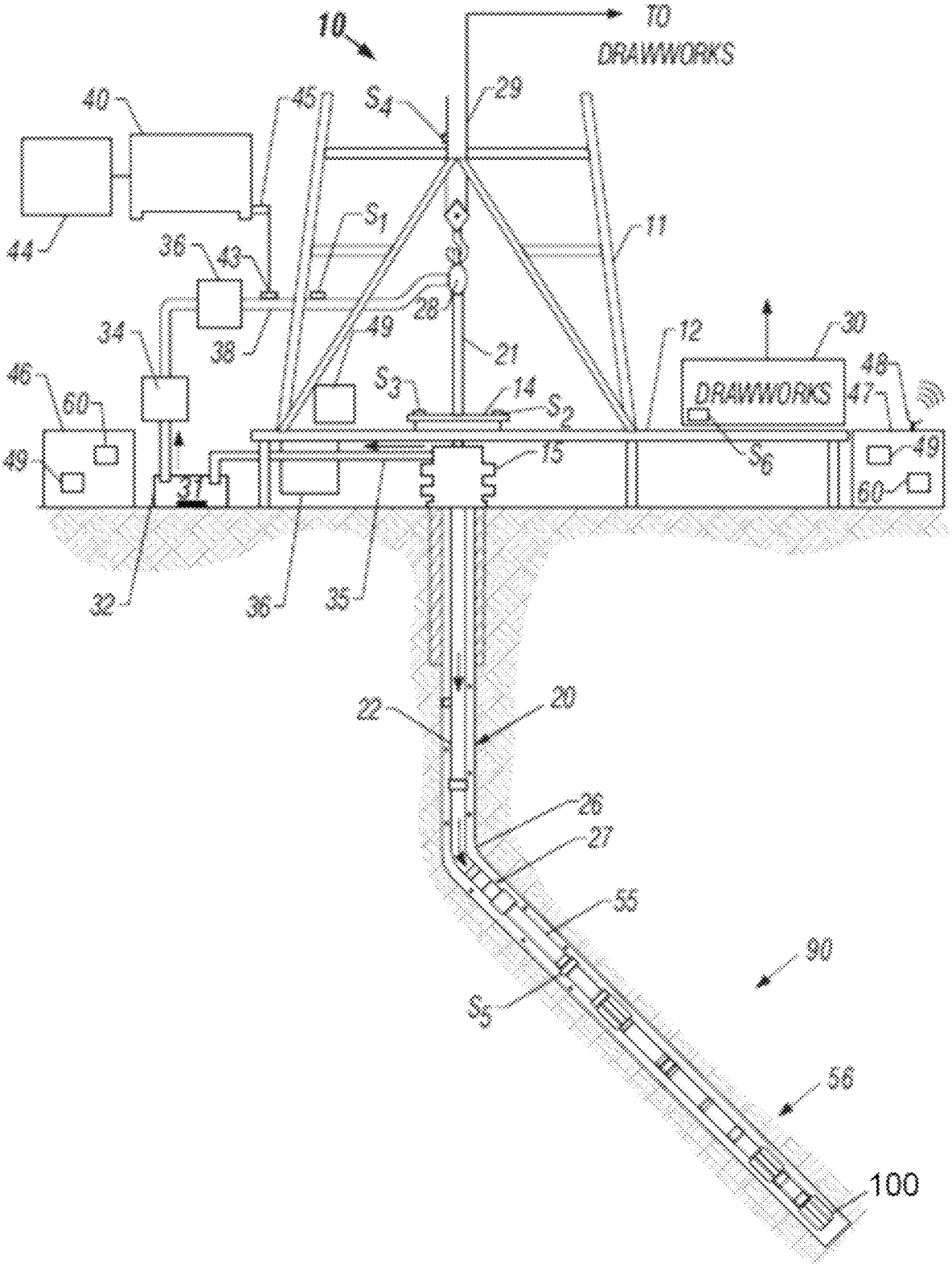
FIG. 1 is a schematic view of a drilling system including an embodiment of a drill bit in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " The term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a part), while the terms "radial" and "radially" generally mean perpendicular to the central axis. For instance, an axial distance refers to a distance measured along or parallel to the central axis, and a radial distance means a distance measured perpendicular to the central axis. Still further, as used herein, the term "component" may be used to refer to a contiguous, single-piece or monolithic structure, part, or device. It is to be understood that a component may be used alone or as part of a larger system or assembly.

Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Drill bits are typically made in a manufacturing plant or factory. From the plant or factory, the drill bits are transported to the field for use. When worn, bits are transported to a repair center or back to the originating factory for maintenance, repair, and/or replacement. During maintenance, the bits are heated, and the cutter elements may be rotated and/or replaced. After maintenance, the drill bits are then transported back to field for further use. This "life-cycle" of drill bits includes wasteful, non-value-added activities, such as transport time from and back to the field, and the associated costs. During such non-value-added activities, bits are not being used in a way that generates revenue, but instead, are idle (e.g., while being transported).

During rotation and/or replacement of worn or damaged cutter elements, the hard cutting layers of the cutter elements may sustain thermal damage when the bit body is heated and/or when replacement cutter elements are brazed to the blades due to the thermal mismatch of the tungsten carbide substrate of the cutter element and the polycrystalline diamond of the cutting layer. Such thermal damage may result in loss of wear resistance, and in extreme cases, cracking.

Furthermore, when the drill bits are heated and cutter elements are brazed, there is a risk of human error that the drill bit will be overheated or a cutter element will be placed directly into an acetylene flame, thereby potentially causing thermal damage. It should also be appreciated that a considerable amount of time is required to heat and braze cutter elements into a drill bit, and still further time is necessary after heating the drill bit to clean the bit (e.g., remove flux in a bath). Subsequent to such heating and cleaning, the drill bits are blasted (e.g., to remove excess braze) and then dye checked for potential cracks in the bit body and/or cutter elements.

For at least the foregoing reasons, there exists a need for drill bits than can be maintained and repaired more efficiently, and for cutter elements that can be replaced or rotated during maintenance and repairs more efficiently. Such drill bits and associated cutter elements would be particularly well received if they offered the potential for such maintenance, repair, replacement, and rotation without enhanced risk of damage to the drill bit or cutter elements.

Accordingly, embodiments described herein are directed to drill bits including cutter element assemblies including a cutter element carrier or stator that is fixably secured to the corresponding blade and a cutter element including a hard cutting layer that is mechanically coupled to the cutter element carrier and corresponding blade. In particular, the cutter element is configured for relatively quick removal, rotation, replacement, attachment, or combinations thereof without the need to heat the bit body or brazing of the cutter element to the blade. As a result, rather than require transport to a factory or repair center, a field office can be positioned in the field for rapid drill bit build customization, repair, and maintenance. In other words, the drill bits and the cutter elements mounted thereto can be repaired, maintained, and replaced (as desired) on site, without transport over long distances (after initial delivery to the field). The cutter elements can be replaced, maintained, and rotated with relative ease. In some embodiments disclosed herein, the cutter elements can be replaced at the field location without requiring heating of the bit, which requires time for both heating and cooling of the bit, as well as presents the risk of thermal damage to the cutter elements. Further, the cutter elements can be secured to the blades without brazing, thereby reducing the propensity for thermal damage to the cutting layers of the cutter elements, and reducing the amount of time the cutter elements are exposed to a deleterious oxygen containing atmosphere at elevated temperatures. Thus, the present disclosure includes methods and systems that reduce the number of bits that are idle.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (for example, rotary table 14) may be augmented or replaced by a top drive suspended in the derrick (for example, derrick 11) and connected to the drillstring (for example, drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 or a top drive, rotated by downhole mud motor 55 disposed along drillstring 20 proximal bit 100, or combinations thereof (for example, rotated by both rotary table 14 via drillstring 20 and mud motor 55, rotated by a top drive and the mud motor 55, etc.). For example, rotation via downhole motor 55 may be employed to supplement the rotational power of rotary table 14, if required, or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations, a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
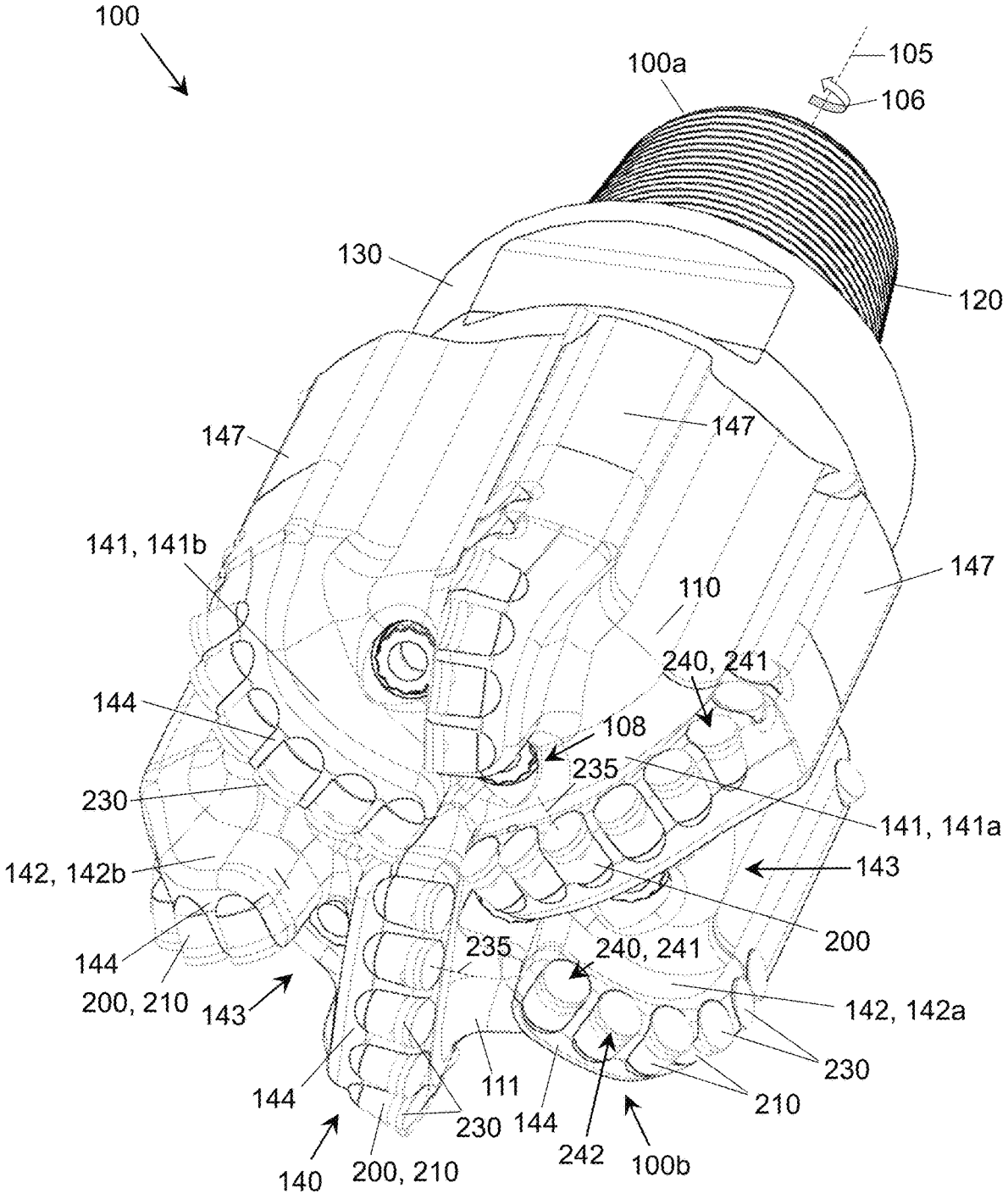
FIG. 2 is a perspective view of the drill bit of FIG. 1.
Figure 3:
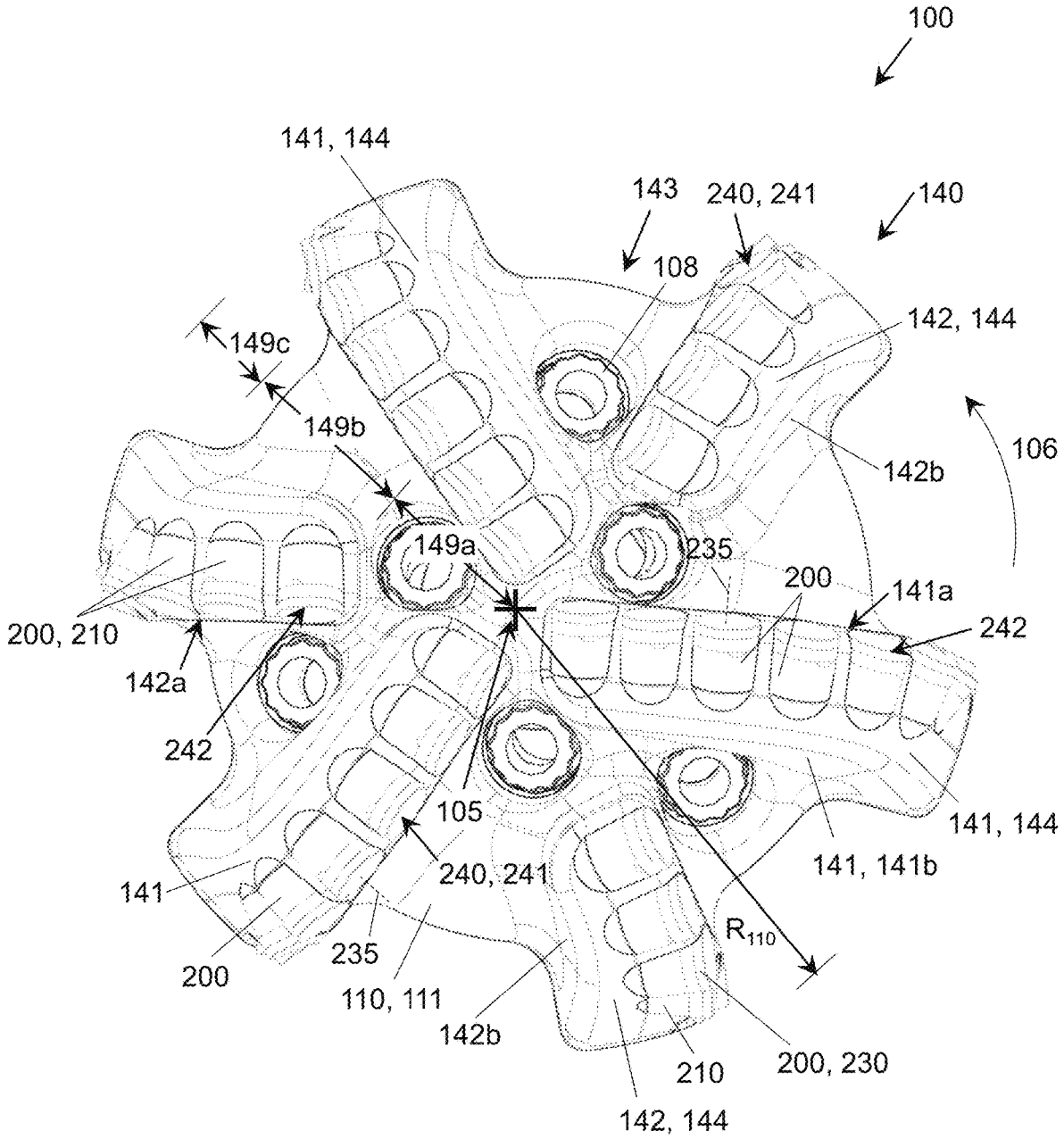
FIG. 3 is a top view of the bit of FIG. 2.

Referring now to FIGS. 2 and 3, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to a drill string 20 (not shown in FIGS. 2 and 3), which is employed to rotate the bit 100 in order to drill the borehole. Bit body 110, shank 130, and pin 120 are coaxially aligned with axis 105, and thus, each has a central axis coincident with axis 105.

Figure 4:
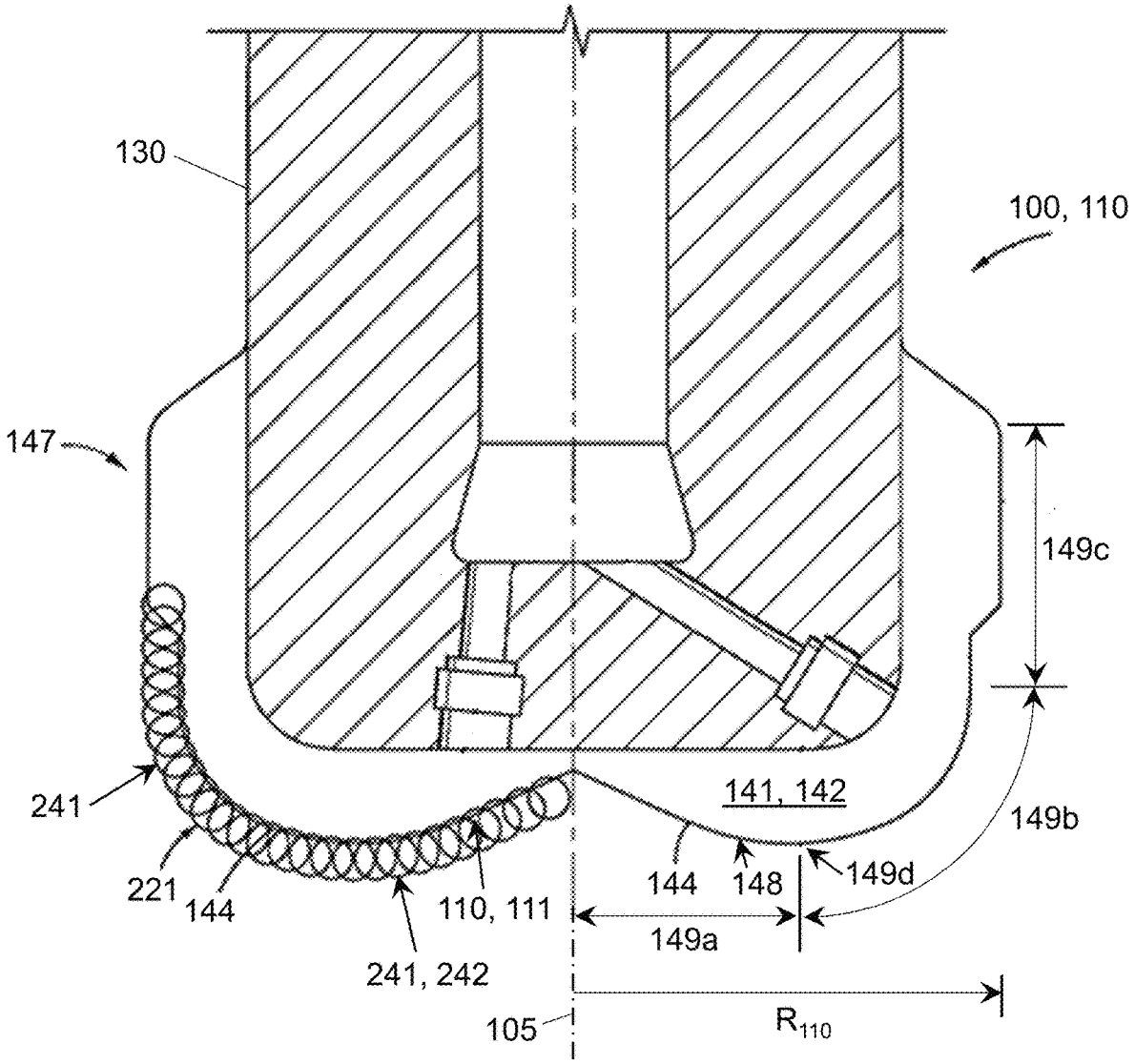
FIG. 4 is a partial cross-sectional view of the bit of FIG. 2 with the blades and the cutting faces of the cutter elements rotated into a single composite profile.

The portion of bit body 110 that faces the formation at downhole end 100*b* includes a bit face 111 provided with a cutting structure 140. Cutting structure 140 includes a plurality of blades that extend from bit face 111. As best shown in FIG. 4, in this embodiment, cutting structure 140 includes three angularly spaced-apart primary blades 141 and three angularly spaced apart secondary blades 142. Further, in this embodiment, the plurality of blades (for example, primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

Referring still to FIGS. 2 and 3, in this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2 and 3, each blade 141, 142 includes a cutter-supporting surface 144 that generally faces the formation during drilling and extends circumferentially from the leading side 141*a* to the trailing side 142 of the corresponding blade 141, 142. In this embodiment, a plurality of cutter element assemblies 200 are fixably attached to cutter supporting surface 144 of each blade 141, 142. Cutter element assemblies 200 are generally arranged adjacent one another in a radially extending row proximal the leading side 141*a*, 142*a* of each blade 141, 142. However, in other embodiments, the cutter element assemblies (for example, cutter element assemblies 200) may be arranged differently.

As will be described in more detail below, each cutter element assembly 200 includes a cutter element carrier 210 fixably mounted to the corresponding blade 141, 142 and a cutter element 230 coupled to and carried by cutter element carrier 210. Although cutter element assemblies 200 are fixably mounted to blades 141, 142, and thus, do not move rotationally or translationally during drilling operations, each cutter element 230 is mechanically attached to the corresponding cutter element carrier 210 such that each cutter element 230 can be independently rotated, removed, replaced or combinations thereof relative to the corresponding cutter element carrier 210 during repair and/or maintenance of drill bit 100. Accordingly, drill bit 100 and cutter element assemblies 200 may be referred to as "modular." Moreover, as each cutter element carrier 210 is fixably secured to the corresponding blade 141, 142 and cannot move rotationally or translationally relative thereto during drilling operations, as well as during rotation, removal or replacement of the corresponding cutter element 230 during repair and/or maintenance of drill bit 100, whereas each cutter element 230 can be rotated, removed, replaced, or combinations thereof relative to the corresponding cutter element carrier 210 during repair and/or maintenance of drill bit 100, each cutter element carrier 210 may also be referred to or described herein as a "stator" and each cutter element 230 may also be referred to or described herein as a "rotor."

As will be described in more detail below, each cutter element 230 includes an elongated and generally cylindrical, T-shaped support base or substrate 231 and a cylindrical disk or tablet-shaped, hard cutting layer 240 bonded to the exposed end of substrate 231. Substrate 231 is made of a carbide material such as tungsten carbide, whereas cutting layer 240 is made of polycrystalline diamond or other superabrasive material. Substrate 231 has a central axis 235, and as will be described in more detail below, is at least partially received and mechanically secured in a receptacle formed in the corresponding cutter element carrier 210, which in turn is fixably received by and secured to the corresponding blade 141, 142 to which it is mounted. The cylindrical disc, hard cutting layer 240 defines a cutting face 241 of the corresponding cutter element 230 and cutter element assembly 200. As will be described in more detail below, in this embodiment, each cutting face 241 is the same and is planar. However, in other embodiments, one or more cutting faces (e.g., cutting faces 241) may not be completely planar, but rather, be non-planar. As used herein, the phrase "non-planar" may be used to refer to a cutting face that includes one or more curved surfaces (for example, concave surface(s), convex surface(s), or combinations thereof), a plurality of distinct planar surfaces that intersect at distinct edges along the cutting face, or both.

In the embodiments described herein, each cutter element assembly 200 is mounted such that the central axis 235 of the corresponding cutter element 230 is oriented substantially parallel to or at an acute angle relative to the cutting direction of the bit (for example, cutting direction 106 of bit 100). Such orientation results in the corresponding cutting face 241 being generally forward-facing relative to the cutting direction of the bit (for example, cutting direction 106 of bit 100). The portion of cutting face 241 of each cutter element 230 positioned furthest from the cutter supporting surface 144 of the corresponding blade 141, 142 as measured perpendicular to the corresponding cutter supporting surface 144 defines a cutting tip 242 of cutting face 241.

Referring still to FIGS. 2 and 3, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter element assemblies 200 wear slightly under gage. Gage pads 147 also help stabilize bit 100 against vibration.

Referring now to FIG. 4, an exemplary profile of blades 141, 142 is shown as it would appear with blades 141, 142 and cutting faces 241 rotated into a single rotated profile. In rotated profile view, blades 141, 142 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* is the radially innermost region of bit body 110 and composite blade profile 148 that extends from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, referred herein to as the nose 149*d*, occurs at the axially outermost portion of composite blade profile 148 (relative to bit axis 105) where a tangent line to the blade profile 148 has a slope of zero. Moving radially outward, adjacent shoulder region 149*b* is the gage region 149*c*, which extends substantially parallel to bit axis 105 at the outer radial periphery of composite blade profile 148. As shown in composite blade profile 148, gage pads 147 define the gage region 149*c* and the outer radius R110 of bit body 110. Outer radius R110 extends to and therefore defines the full gage diameter of bit 100.

Referring briefly to FIG. 4, moving radially outward from bit axis 105, bit 100 and bit face 111 include cone region 149*a*, shoulder region 149*b*, and gage region 149*c* as previously described. Primary blades 141 extend radially along bit face 111 from within cone region 149*a* proximal bit axis 105 toward gage region 149*c* and outer radius R110. Secondary blades 142 extend radially along bit face 111 from proximal nose 149*d* toward gage region 149*c* and outer radius R110. Thus, in this embodiment, each primary blade 141 and each secondary blade 142 extends substantially to gage region 149*c* and outer radius R110. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (for example, primary blades 141, secondary blades, 142, etc.), and cutter elements (for example, cutter element assemblies 200) are possible.

Bit 100 includes an internal plenum extending axially from uphole end 100*a* through pin 120 (not shown in FIG. 4) and shank 130 into bit body 110. The plenum allows drilling fluid to flow from the drill string into bit 100. Body 110 is also provided with a plurality of flow passages extending from the plenum to downhole end 100*b*. As best shown in FIGS. 2 and 3, a nozzle 108 is seated in the lower end of each flow passage. Together, the plenum, passages, and nozzles 108 serve to distribute drilling fluid around cutting structure 140 to flush away formation cuttings and to remove heat from cutting structure 140, and more particularly cutter element assemblies 200, during drilling.

Referring again to FIGS. 2 and 3, on each blade 141, 142, cutter element assemblies 200 are arranged side-by-side in a row along the corresponding cutter supporting surface 144. Thus, in this embodiment, cutter element assemblies 200 are positioned radially adjacent one another on a given blade 141, 142. However, in other embodiments, the cutter element assemblies (for example, cutter element assemblies 200) may be arranged in rows with one or more cutter elements having different geometries on the same blade (for example, blade 141, 142).

Figure 5:
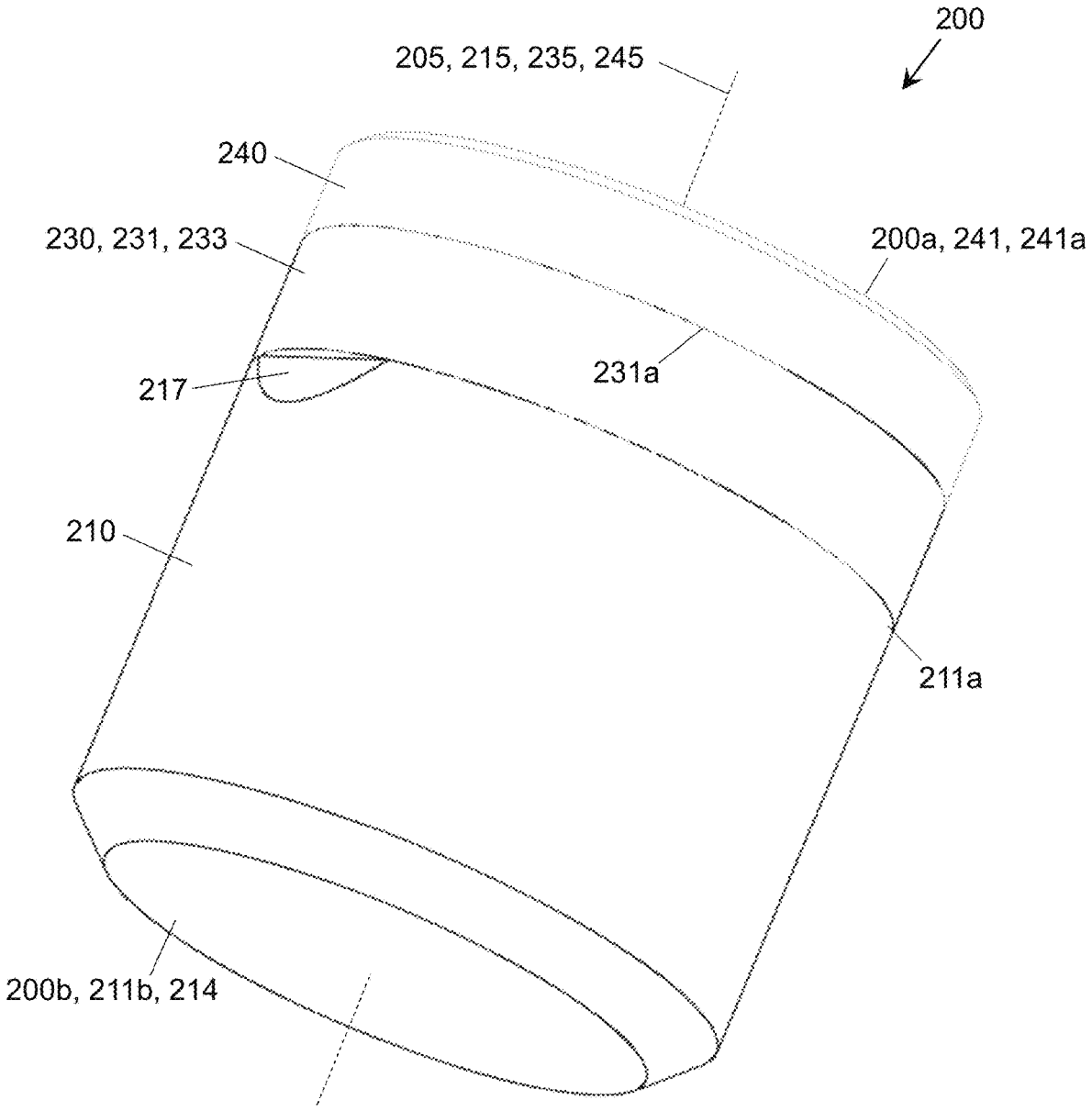
FIG. 5 is a perspective view of one of the cutter element assemblies of the drill bit of FIG. 2.
Figure 6:
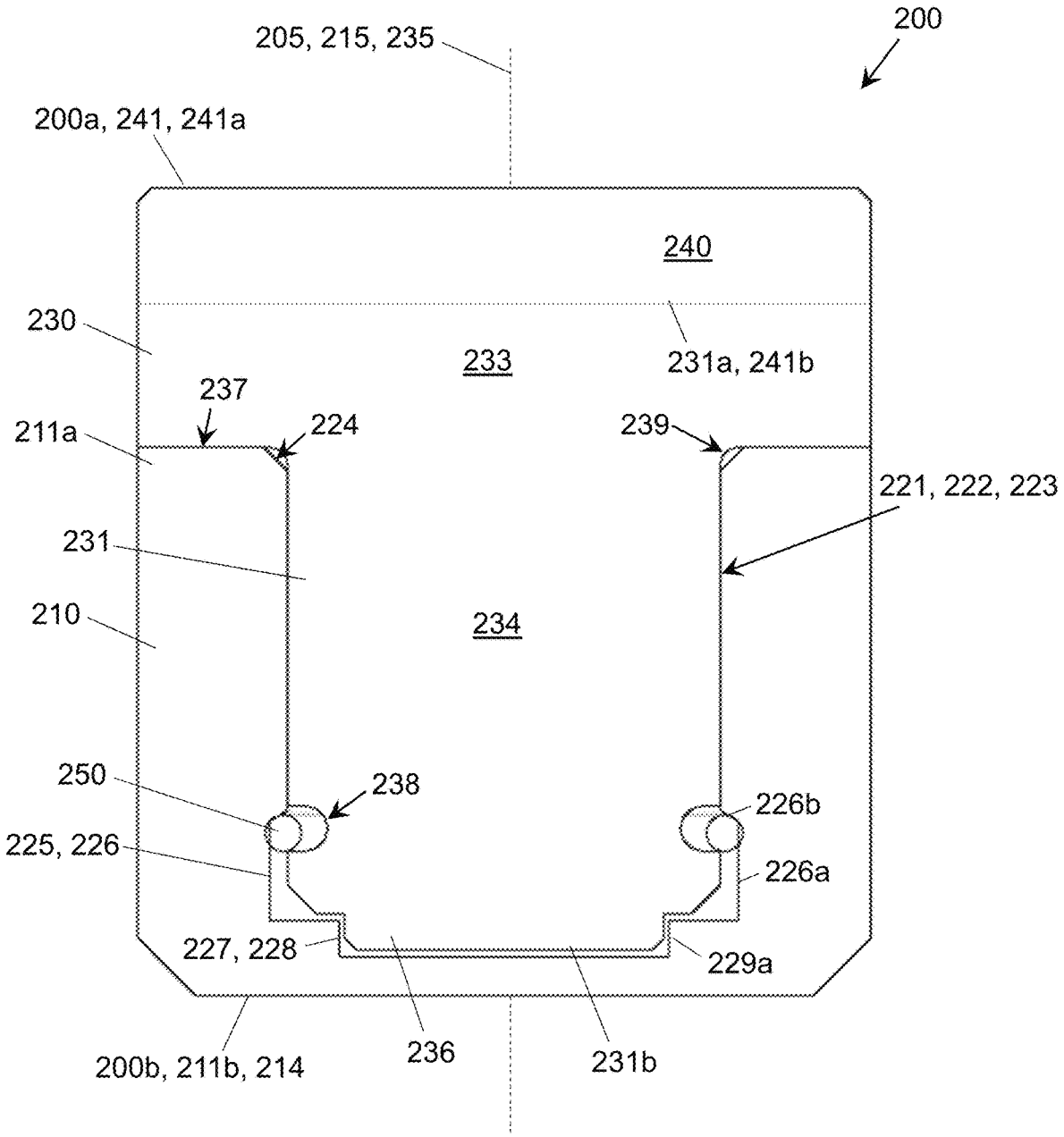
FIG. 6 is cross-sectional side view of the cutter element assembly of FIG. 5.

Referring now to FIGS. 5 and 6, one cutter element assembly 200 will be described with the understanding all of the cutter element assemblies 200 are the same. As described above, in this embodiment cutter element assembly 200 includes a cutter element carrier 210 and a cutter element 230 rotatably and removably coupled to and carried by cutter element carrier 210. As best shown in FIG. 5, cutter element assembly 200 also includes an annular locking member or ring 250 radially positioned between cutter element carrier 210 and cutter element 230 to restrict the axial movement and removal of cutter element 230 from cutter element carrier 210 during drilling operations. In addition, cutter element assembly 200 has a central or longitudinal axis 205, a first or leading end 200*a* (relative to cutting direction 106) defined by cutting face 241 of cutter element 230, and a second or trailing end 200*b* (relative to cutting direction 106) defined by cutter element carrier 210. Central axis 205 is coaxially aligned with central axis 235 of cutter element 230 and a central axis 215 of cutter element carrier 210.

Cutter element carrier 210 is fixably secured to the corresponding blade 141, 142 (e.g., via brazing) and cannot move rotationally or translationally relative thereto during drilling operations, as well as during rotation, removal or replacement of the corresponding cutter element 230 during repair and/or maintenance of drill bit 100. Cutter element 230 is fixably secured to cutter element carrier 210 via mechanical coupling and cannot move rotationally or translationally relative thereto during drilling operations, but can be rotated, removed, replaced, or combinations thereof relative to cutter element carrier 210 during repair and/or maintenance of drill bit 100.

Figure 7:
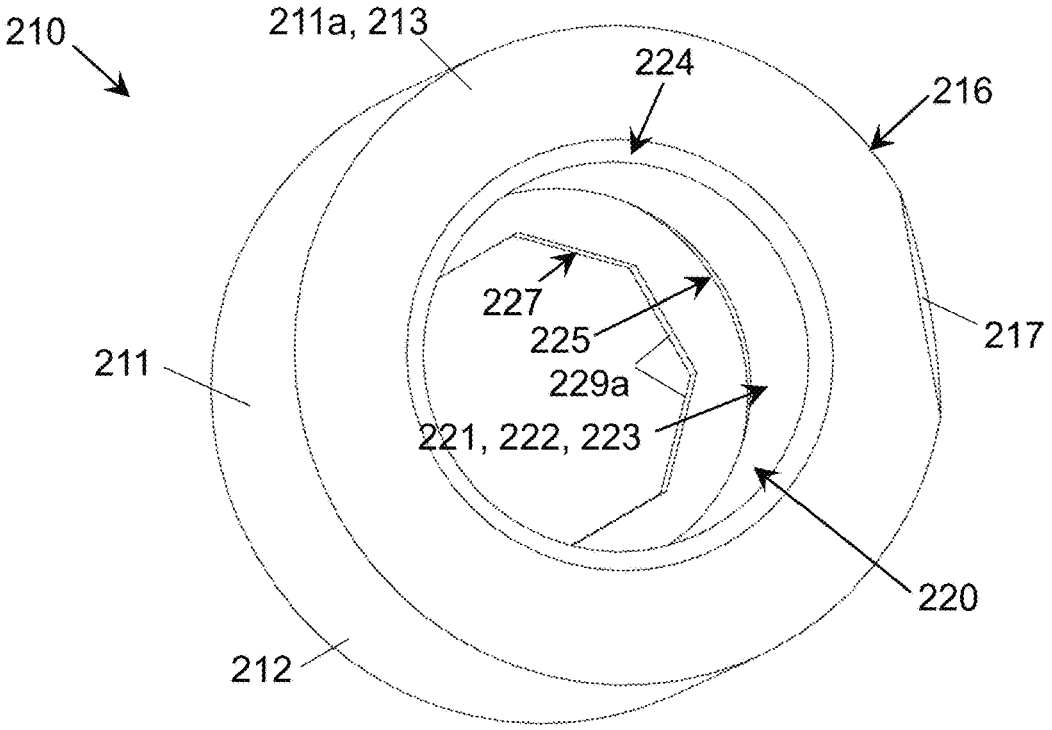
FIG. 7 is a perspective view of the stator of the cutter element assembly of FIG. 5.
Figure 8:
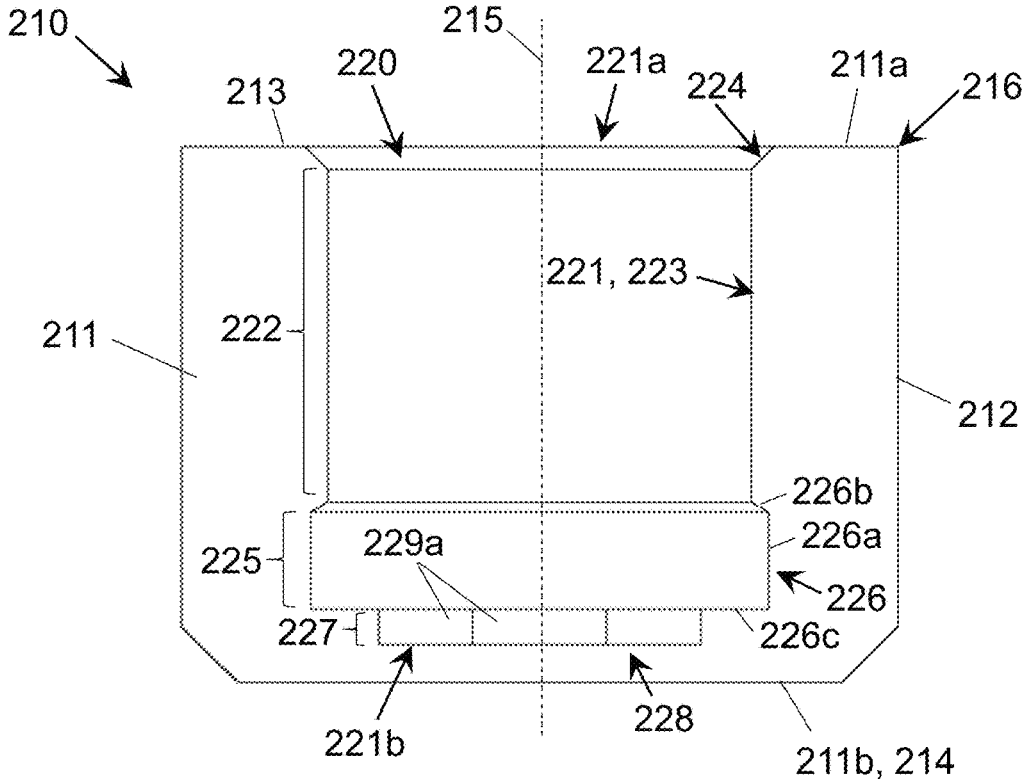
FIG. 8 is a cross-sectional side view of the cutter element carrier of FIG. 5.

Referring now to FIGS. 7 and 8, cutter element carrier 210 includes a generally cylindrical cup-shaped body 211 having a central axis 215, a first end 211*a*, a second end 211*b* opposite first end 211*a*, a radially outer cylindrical surface 212 extending axially from first end 211*a* to second end 211*b*, and a receptacle 220 extending axially from first end 211*a*. In this embodiment, first end 211*a* of body 211 is defined by a planar surface 213 oriented perpendicular to axis 215, and second end 211*b* of body 211 is defined by a planar surface 214 oriented perpendicular to axis 215. Planar surface 214 intersects radially outer cylindrical surface 212 at an annular edge 216. A planar flat 217 is provided along annular edge 216 for removing cutter element 230 from cutter element carrier 210 as will be described in more detail below. Planar flat 217 is disposed in a plane that is preferably oriented at an angle ranging from 30° to 60° relative to central axis 215, and more preferably oriented at 45° relative to central axis. In this embodiment, an annular bevel or chamfer extends circumferentially about body 211 between planar surface 215 at end 211*b* and radially outer cylindrical surface 212.

Receptacle 220 extends axially into body 211 at first end 211*a* but does not extend to or through second end 211*b*. Accordingly, first end 211*a* may generally be described as an "open" end of body 211 and second end 211*b* may generally be described as a "closed" end of body 211. When cutter element assembly 200 is mounted to a blade 141, 142, cutter element carrier 210 is oriented such that first end 211*a* leads second end 211*b* relative to cutting direction 106.

Receptacle 220 has a first or open end 221*a* at first end 211*a* of body 211 and a second or closed end 221*b* disposed within body 211 opposite first end 221*a*. In addition, receptacle 220 defines a radially inner surface 221 of body 211 that extends axially from open end 221*a* to closed end 221*b*. Receptacle 220 includes several different sections or profiles along its axial length. In particular, receptacle 220 includes a cutter element support or bearing section 222 extending axially from open end 221*a*, an axial locking section 225 axially adjacent cutter element bearing section 222, and a rotational locking section 227 extending axially from closed end 221*b* to axial locking section 225. Thus, cutter element bearing section 222 is disposed at or proximal open end 221*a*, axial locking section 225 is axially positioned between cutter element bearing section 222 and rotational locking section 227, and rotational locking section 227 is disposed at or proximal closed end 221*b*. Cutter element bearing section 222, axial locking section 225, and rotational locking section 227 are coaxially aligned with central axis 215. As will be described in more detail below, cutter element bearing section 222 slidably engages and supports the portion of cutter element 210 that is removably seated in receptacle 220, axial locking section 225 functions in connection with locking member 250 to restrict and/or prevent cutter element 230 from moving axially relative to cutter element carrier 210 and inadvertently being removed from cutter element carrier 210 during drilling operations, and rotational locking section 227 functions in connection with a mating profile of cutter element 230 to restrict and/or prevent cutter element 230 from rotating relative to cutter element carrier 210 during drilling operations.

Cutter element bearing section 222 includes a cylindrical surface 223 disposed along radially inner surface 221 and an annular bevel or chamfer 224 extending axially between planar surface 213 at open end 221*a* and cylindrical surface 223. Annular bevel 224 is a frustoconical surface. Axial locking section 225 includes an annular recess 226 extending radially outward relative to sections 222, 227. Recess 226 is defined by a radially outer cylindrical surface 226*a* disposed along radially inner surface 221. Cylindrical surface 226*a* is disposed at a radius (relative to axis 215) that is greater than the radius of cylindrical surface 223. A frustoconical shoulder 226*b* extends radially inward from cylindrical surface 226*a* to cylindrical surface 223, and a planar shoulder 226*c* oriented perpendicular to axis 215 extends radially inward from cylindrical surface 226*a* to rotational locking section 227. In this embodiment, rotational locking section 227 includes a locking recess 228 defined by a plurality of circumferentially adjacent planar flats or surfaces 229*a* extending axially from planar shoulder 226*c* to closed end 221*b*. Planar flats 229*a* are oriented parallel to central axis 215 and are circumferentially connected end-to-end to form a closed geometric shape disposed about central axis 215. In particular, in this embodiment, planar flats 229*a* form an octagon concentric with central axis 215.

Figure 9:
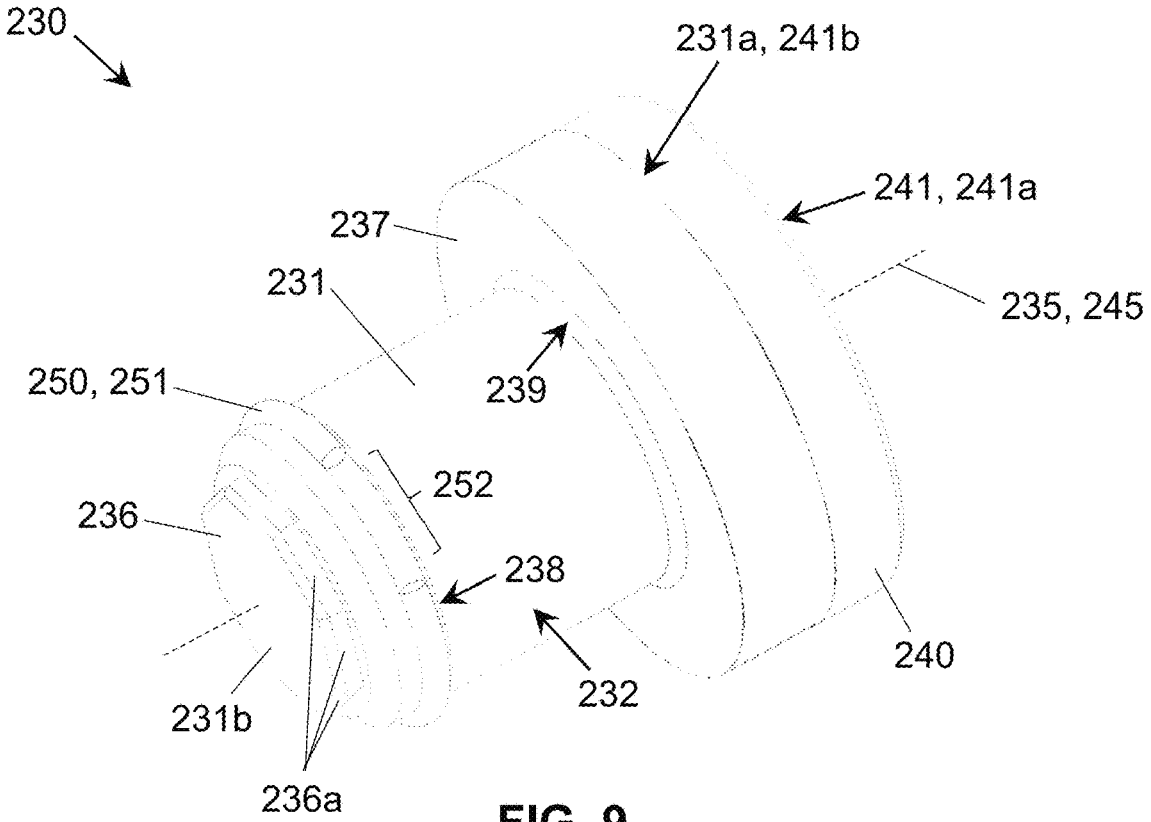
FIG. 9 is a perspective view of the cutter element of FIG. 5.
Figure 10:
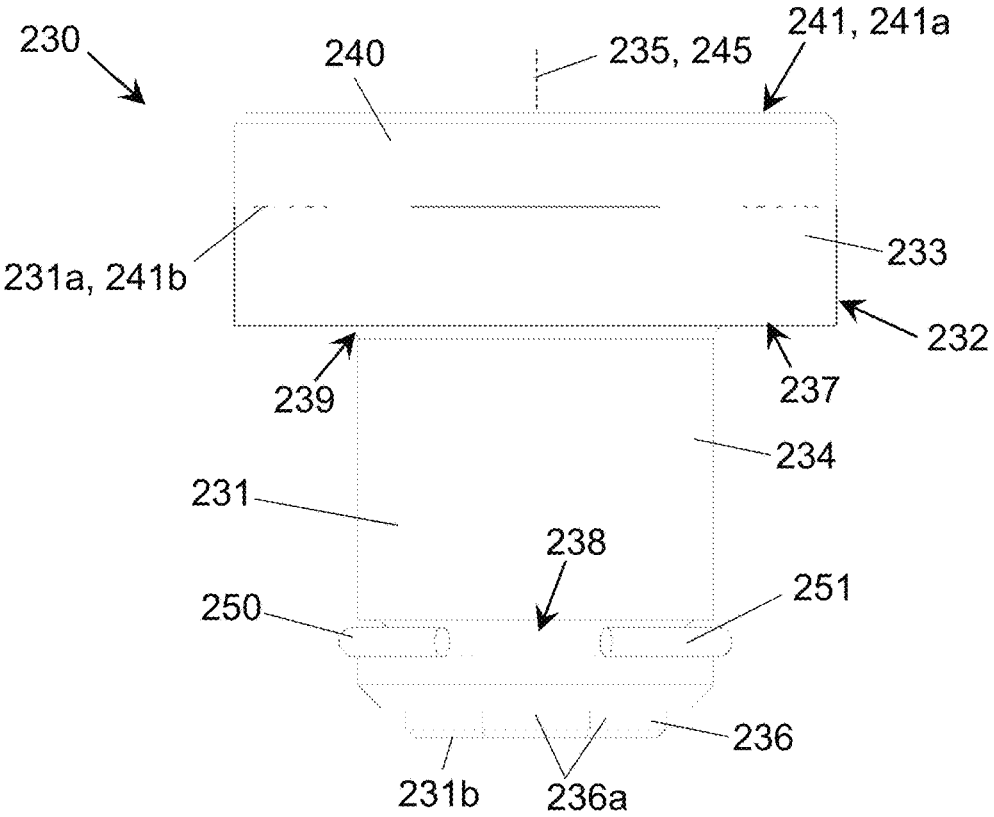
FIG. 10 is a side view of the cutter element of FIG. 5.

Referring now to FIGS. 9 and 10, as briefly described above, cutter element 230 includes an elongated and generally cylindrical, T-shaped support base or substrate 231 and a cylindrical disk or tablet-shaped, hard cutting layer 240 bonded to substrate 231. As also briefly described above, substrate 231 is made of a carbide material such as tungsten carbide, whereas cutting layer 240 is made of polycrystalline diamond or other superabrasive material. When cutter element assembly 200 is mounted to a blade 141, 142, cutter element 230 is oriented such that cutting layer 240 and associated cutting face 241 lead substrate 231 (and cutter element carrier 210) relative to cutting direction 106.

Substrate 231 has a central or longitudinal axis 235 that defines the central axis of cutter element 230, a first or leading end 231*a* (relative to cutting direction 106), a second or trailing end 231*b* (relative to cutting direction 106), and a radially outer surface 232 extending axially from first end 231*a* to second end 231*b*. In this embodiment, substrate 231 includes a cylindrical head 233 at leading end 231*a*, a cylindrical shaft 234 extending axially from head 233, and a locking key 236 extending from the end of shaft 234 opposite head 233 to second end 231*b*. Head 233, shaft 234, and key 236 have central axes that are coaxially aligned with central axis 235. Head 233 has a cylindrical outer surface disposed along radially outer surface 232, and shaft 234 has a cylindrical outer surface disposed along radially outer surface 232. The outer cylindrical surface of head 233 is disposed at a radius that is greater than the radius of the outer cylindrical surface of shaft 234. A planar annular shoulder 237 extends radially inward from head to shaft 234. Without being limited by this or any particular theory, the annular concave intersection between head 233 and shaft 234 along outer surface 232 may be particularly prone to stress concentrations during drilling operations, and thus, may define a failure point for substrate 231 and cutter element 230. Accordingly, in this embodiment, an annular concave rounded transition or radius 239 is provided at the intersection between planar shoulder and the cylindrical outer surface of shaft 234. An annular recess 238 is provided in the cylindrical outer surface of shaft 234 proximal locking key 236. In this embodiment, annular recess 238 has a semi-circular cross-sectional shape. Annular recess 238 is sized to receive and retain mating annular locking ring 250.

Referring still to FIGS. 9 and 10, locking key 236 is sized and shaped to positively engage and mate with locking recess 228 of cutter element carrier 210. As previously described, in this embodiment, locking recess 228 includes a plurality of circumferentially adjacent planar flats 229*a* oriented parallel to central axis 215 and circumferentially connected end-to-end to form an octagonal shape. Accordingly, in this embodiment, locking key 236 includes a plurality of circumferentially adjacent planar flats 236*a* extending axially from shaft 234 to end 231*b*, oriented parallel to central axis 235, and circumferentially connected end-to-end to form an octagonal shape sized to mate and engage locking recess 228.

As described, locking key 236 of cutter element 230 and recess 228 of cutter element carrier 210 are sized and shaped to mate and positively engage to restrict and/or prevent rotation of cutter element 230 relative to cutter element carrier 210 about coaxially aligned axes 205, 215, 235, 245. In this embodiment, locking key 236 and recess 228 comprise planar flats 229*a*, 236*a* circumferentially connected end-to-end in an octagonal shape. However, it should be appreciated that there are numerous other complimentary shapes for the locking key (e.g., locking key 236) and the mating recess (e.g., mating recess 228) that positively engage to restrict and/or prevent rotation of the cutter element (e.g., cutter element 230) relative to the cutter element carrier (e.g., cutter element carrier 210) about the corresponding central axes (e.g., axes 205, 215, 235, 245). In general, positive engagement of any pair of mating complimentary shapes other than complementary cylindrical shapes that are concentric with the central axes of the cutter element and the cutter element carrier will restrict and/or prevent rotation of the cutter element relative to the cutter element carrier. However, in some embodiments, it may be desirable to enable rotational indexing of the cutter element relative to the cutter element carrier about the corresponding central axes to allow the cutter element to be removed from the cutter element carrier, rotated less than 360°, and then re-installed in the cutter element carrier, as described in more detail below, to define the cutting tip of the cutter element with a different portion of the cutting layer (e.g., cutting layer 240) such that a given cutter element can be reused as opposed to simply being replaced. For such embodiments, complementary geometric shapes that are concentric and coaxially aligned with the central axes of the cutter element and the cutter element carrier, and are generally symmetric about the central axes and/or are mirror images across a plane containing the central axes, which offer more than one indexing position (e.g., oval, hexagonal, pentagonal, triangular, rectangular, cylindrical with circumferentially-spaced flats, cylindrical with uniformly circumferentially spaced radial projects and mating recesses, etc.), may be particularly preferred. In other embodiments, mating complimentary shapes that are not symmetric about the central axes may be employed to restrict and/or prevent rotation of the cutter element relative to the cutter element carrier with the understanding that rotational indexing of the cuter element relative to the cutter element carrier about the corresponding central axes may not be an option with such embodiments.

Hard cutting layer 240 has a tablet or disc-shaped body with a central axis 245, a first or leading end 241*a* (relative to cutting direction 106), and a second or trailing end 241*b* opposite end 241*a*. Cutting face 241 is disposed at leading end 241*a*, and trailing end 241*b* is fixably bonded to leading end 231*a* of substrate 231. Body 241 has a radially outer cylindrical surface that is disposed at the same radius as head 233, and thus, the outer cylindrical surfaces of body 241 and head 233 are contiguous.

As previously described, locking ring 250 is received in mating annular recess 238. In particular, locking ring 250 is a retaining ring having a resilient annular body 251 including a gap or slit 252 along the body 251, thereby allowing locking ring 250 to radially expand and retract. More specifically, locking ring 250 is made of a resilient metal or metal alloy that allows locking ring 250 to transition between a relaxed and unstressed state or position in which lock ring 250 extends partially, radially outwardly from recess 238; a stressed and radially compressed state or position in which lock ring 250 is radially disposed completely within recess 238; and a stressed and radially expanded state or position in which lock ring 250 is radially disposed completely out of recess 238. Thus, the diameter of ring 250 in the radially expanded state is greater than the diameter of ring 250 in the relaxed state, and the diameter of ring 250 in the relaxed state is greater than the diameter of ring 250 in the radially compressed state.

Referring now to FIGS. 3, 5, 6, 9, and 10, the assembly and mounting of one cutter element assembly 200 to a blade 141, 142 of bit body 110 will now be described with the understanding the other cutter element assemblies 200 are assembled and mounted to corresponding blades 141, 142 in the same manner to form drill bit 100. In embodiments described herein, cutter element assembly 200 is assembled after mounting cutter element carrier 210 to cutter supporting surface 144 of the corresponding blade 141, 142. More specifically, cutter element carrier 210 is seated in a mating pocket in cutter supporting surface 144 and fixably secured therein via brazing. Next, locking ring 250 is expanded radially outwardly from the relaxed state to a radially expanded state or position such that ring 250 has an inner diameter greater than the outer diameter of shaft 234, and then trailing end 231*a* of substrate 231 is inserted into the radially expanded ring 250 and ring 250 is axially advanced along shaft 234 until it is axially aligned with mating recess 238. Then, ring 250 is allowed to transition from the radially expanded state back to the relaxed state such that ring 250 is partially radially disposed in recess 238 and partially radially extends from recess 238 as shown in FIG. 9. With ring 250 mounted to shaft 234 of cutter element 230 and seated in recess 238, cutter element 230 is coaxially aligned with cutter element carrier 210, trailing end 231*a* of substrate 231 of cutter element 230 is inserted into and axially advanced into open end 221*a* of receptacle 220. As shaft 234 is advanced into receptacle 220, the cylindrical outer surface of shaft 234 slidingly engages mating cylindrical surface 223 of receptacle 220 and as locking ring 250 is urged into recess 238 and transitioned to the radially compressed state by annular bevel 224. Shaft 234 is advanced axially into receptacle 220 until the near simultaneous seating of locking key 236 in mating locking recess 228, axial alignment of locking ring 250 and annular recess 226, and axial abutment of annular shoulder 237 and first end 211*a* of body 211, thereby completing the assembly of cutter element assembly 200 following attachment of cutter element carrier 210 to the corresponding blade 141, 142. It should be appreciated that due to the mating but non-cylindrical geometries of key 236 and recess 228, cutter element 230 may need to be rotated about axes 215, 235 to circumferentially aligned key 236 and recess 228 to allow key 236 to positively engage and be fully seated in recess 228. With key 236 sufficiently seated in recess 228, cutter element 230 is restricted and/or prevented from rotating relative to cutter element carrier 210. It should also be appreciated that once locking ring 250 is axially aligned with recess 226, locking ring 250 is free to transition from the radially compressed state to the relaxed state as shown in FIG. 5 with ring 250 partially radially disposed in both recesses 228, 238, thereby restricting and/or preventing cutter element 234 from moving axially in a direction generally exiting receptacle 220 and ensuring continued positive engagement of key 236 and recess 228.

In the manner described, cutter element carrier 210 is mounted to a corresponding blade 141, 142, and then cutter element assembly 200 is mechanically made up by coupling cutter element 230 to cutter element carrier 210. This approach to coupling cutter element assembly 200 to blade 141, 142 by first brazing cutter element carrier 210 to blade 141, 142 and then mechanically coupling cutter element 230 to cutter element carrier 210 to form cutter element assembly 200 reduces exposure of the thermal energy associated with the brazing process, thereby reducing and/or avoiding undesirable thermal damage to the polycrystalline diamond of the cutting layer 240 of cutter element 230.

With cutter element assemblies 200 mounted to blades 141, 142 to form drill bit 100, it can be deployed downhole for drilling operations. During such drilling operations, cutter elements 230 are restricted and/or prevented from rotating relative to corresponding cutter element carriers 210 via positive engagement of mating keys 236 and recesses 228, and cutter elements 230 are restricted and/or prevented from inadvertently being removed from corresponding cutter element carriers 210 via engagement of locking rings 250 with annular recesses 228, 238. However, as desired or needed during drilling operations, drill bit 100 can be tripped (i.e., retrieved to the surface) to replace one or more cutter elements 230 and/or rotate one or more cutter elements 230 to position a different portion of cutting layer 240 furthest from the cutter-supporting surface 144 to define a new fresh, unworn cutting tip 242 for the corresponding cutter element assembly 200.

To replace a cutter element 230, a tool such as a screwdriver is wedged between head 233 of cutter element 230 and first end 211*a* of body 211 at planar flat 217 to pry cutter element 230 and cutter element carrier 210 axially apart. Locking ring 250 resists the axial separation of cutter element 230 from cutter element carrier 210, however, with sufficient axial separation force applied, locking ring 250 is urged radially inward to transition from the relaxed state to the radially compressed state completely within annular recess 238 via annular frustoconical shoulder 226*b*, thereby allowing cutter element 230 to be pulled axially from receptacle 220. With cutter element carrier 210 remaining secured to the corresponding blade 141, 142, a new cutter element 230 can be installed as previously described to form a cutter element assembly 200 with the new cutter element 230 having a fresh, unworn cutting layer 240 and associated cutting face 241.

To rotate a cutter element 230 relative to the corresponding cutter element carrier 210, a tool such as a screwdriver is wedged between head 233 of cutter element 230 and first end 211*a* of body 211 at planar flat 217 to pry cutter element 230 and cutter element carrier 210 axially apart as previously described while cutter element carrier 210 remains secured to the corresponding blade 141, 142. Once locking ring 250 has disengaged recess 228 and is completely radially positioned within recess 238, and key 236 has been axially removed from mating recess 228, cutter element 230 can be rotated about axes 215, 235 to the desired rotational position, and then advanced axially back into receptacle until the near simultaneous seating of locking key 236 in mating locking recess 228, axial alignment of locking ring 250 and annular recess 226, and axial abutment of annular shoulder 237 and first end 211*a* of body 211, thereby re-completing the assembly of cutter element assembly 200. It should be appreciated that due to the mating but non-cylindrical geometries of key 236 and recess 228, cutter element 230 may need to be rotated to a minor degree about axes 215, 235 to circumferentially aligned key 236 and recess 228 to allow key 236 to positively engage and be fully seated in recess 228.

In the manners described, a cutter element 230 of a cutter element assembly 200 can be mechanically replaced and/or rotated, while the corresponding cutter element carrier 210 remains secured to the blade 141, 142. This approach does not require the use of thermal energy (e.g., brazing) and can be performed with relatively simple tools available at a drilling site, thereby (i) reducing and/or avoiding undesirable thermal damage to the polycrystalline diamond of the cutting layer 240 of cutter element 230, and (ii) enabling the relatively quick changing and/or rotating of the cutter element 230 at the drilling site for efficient repair and/or maintenance.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element assembly for a fixed cutter drill bit, the cutter element assembly comprising:

a cutter element carrier configured to be fixable attached to a cutter-supporting surface of a blade of the fixed cutter drill bit, wherein the cutter element carrier has a central axis, a first end, a second end opposite the first end, and a receptacle extending axially from the first end; and a cutter element having a central axis coaxially aligned with the central axis of the cutter element carrier, a first end, and a second end opposite the first end of the cutter element, wherein the cutter element includes a substrate and a cutter layer fixably attached to the substrate, wherein the substrate includes a shaft extending from the second end of the cutter element and a head, wherein the cutter layer is fixably attached to the head and is disposed at the first end of the cutter element;

wherein the shaft of the substrate is slidingly disposed in the receptacle with the head seated against the first end of the cutter element carrier;

wherein the cutter element is axially locked relative to the cutter element carrier such that the cutter element is prevented from moving axially relative to the cutter element carrier;

wherein the cutter element is rotationally locked relative to the cutter element carrier such that the cutter element is prevented from rotating about the central axis of the cutter element relative to the cutter element carrier;

wherein the receptacle defines a radially inner surface of the cutter element carrier extending from the first end of the cutter element carrier;

wherein the radially inner surface comprises:

an annular chamfer extending axially relative to the central axis of the cutter element carrier from the first end of the cutter element carrier;

a cylindrical surface extending axially relative to the central axis of the cutter element carrier from the annular chamfer;

an annular recess axially adjacent the cylindrical surface relative to the centra axis of the cutter element carrier and extending radially outward relative to the cylindrical surface; and a locking recess extending axially relative to the central axis of the cutter element carrier from the annular recess to a closed end of the receptacle.

2. The cutter element assembly of claim 1, wherein the receptacle includes a bearing section defined by the cylindrical surface of the radially inner surface of the receptacle, an axial locking section axially adjacent the bearing section relative to the central axis of the cutter element carrier and defined the annular recess of the radially inner surface of the receptacle, and a rotational locking section axially adjacent the axial locking section relative to the central axis of the cutter element carrier and defined by the locking recess of the radially inner surface of the receptacle, wherein the axial locking section is axially positioned between the bearing section and the rotational locking section relative to the central axis of the cutter element carrier.

3. The cutter element assembly of claim 1, wherein the annular recess of the radially inner surface includes a frustoconical shoulder extending axially from the cylindrical surface of the radially inner surface.

4. The cutter element assembly of claim 1, wherein the shaft of the cutter element slidingly engages the cylindrical surface of the radially inner surface of the cutter element carrier.

5. The cutter element assembly of claim 1, wherein the second end of the cutter element comprises a locking key that positively engages and mates with the locking recess, wherein engagement of the locking key and the locking recess is configured to prevent rotation of the cutter element relative to the cutter element carrier about the central axis of the cutter element.

6. The cutter element assembly of claim 1, wherein the locking key has a first geometry and the locking recess has a second geometry that is complimentary to and mates with the first geometry of the locking key, wherein the first geometry and the second geometry are symmetric about the central axes of the cutter element carrier and the cutter element.

7. The cutter element assembly of claim 1, wherein the locking key has a first geometry and the locking recess has a second geometry that is complimentary to and mates with the first geometry of the locking key, wherein the first geometry and the second geometry are not symmetric about the central axes of the cutter element carrier and the cutter element.

8. The cutter element assembly of claim 1, wherein the locking key comprises a plurality of planar flats and the locking recess is defined by a plurality of planar flats, wherein the planar flats of the locking key slidingly engage the planar flats of the locking recess.

9. The cutter element assembly of claim 8, wherein the planar flats of the locking key and the planar flats of the locking recess are oriented parallel to the central axis of the cutter element and the planar flats of the locking recess are oriented parallel to the central axis of the cutter element carrier.

10. The cutter element assembly of claim 1, wherein the cutter element has a radially outer surface comprising a cylindrical surface along the shaft and an annular recess in the cylindrical surface;

wherein an annular locking ring is positioned between the shaft of the cutter element and the cutter element carrier, and wherein the annular locking ring extends radially inwardly into the annular recess in the cylindrical surface of the shaft and extends radially outwardly into the annular recess of the radially inner surface of the cutter element carrier.

11. The cutter element assembly of claim 1, wherein the first end of the cutter element carrier comprises a planar surface oriented perpendicular to the central axis of the cutter element carrier;

wherein the cutter element carrier has a radially outer cylindrical surface extending from the first end of the cutter element carrier to the second end of the cutter element carrier;

wherein a planar flat extends from the planar surface at the first end of the cutter element carrier to the radially outer cylindrical surface.

12. The cutter element assembly of claim 1, wherein the cutter element carrier has a radially outer cylindrical surface extending from the first end of the cutter element carrier to the second end of the cutter element carrier;

wherein the head of the substrate has a radially outer cylindrical surface contiguous with the radially outer cylindrical surface of the cutter element carrier;

wherein the cutting layer of the cutter element has a radially outer cylindrical surface contiguous with the radially outer cylindrical surface of the head.

13. A fixed cutter drill bit for drilling a borehole in an earthen formation, the drill bit having a central axis and a cutting direction of rotation about the central axis, the drill bit comprising a bit body configured to rotate about the central axis in the cutting direction of rotation, wherein the bit body includes a bit face;

a blade extending radially along the bit face, wherein the blade has a leading side relative to the cutting direction of rotation, a trailing side relative to the cutting direction of rotation, and a cutter-supporting surface extending from the leading side to the trailing side;

the cutter element assembly of claim 3 mounted to the cutter-supporting surface of the blade, wherein the cutter element carrier is fixably attached to the cutter supporting surface of the blade.

14. A method for mounting the cutter element of claim 1 to a blade of the fixed cutter drill bit, the method comprising:

(a) axially inserting the shaft of the substrate into the receptacle of the cutter element carrier fixably mounted to the blade;

(b) axially locking the cutter element to the cutter element carrier during (a) such that the cutter element is restricted from moving axially relative to the cutter element carrier; and (c) rotationally locking the substrate relative to the cutter element carrier during (a) such that the cutter element is prevented from rotating about a central axis of the cutter element relative to the cutter element carrier.

15. The method of claim 14, further comprising:

transitioning an annular locking ring from a relaxed state to a radially expanded state before (a);

axially advancing the locking ring along the shaft of the substrate of the cutter element to an annular recess disposed along the shaft of the substrate with the annular locking ring in the radially expanded state before (a);

transitioning the annular locking ring from the radially expanded state to the relaxed state to allow the annular locking ring to at least partially radially extend into the annular recess of the shaft before (a).

16. The method of claim 15, further comprising:

(d) transitioning the annular locking ring to a radially compressed state to urge the annular locking ring completely into the annular recess of the shaft during (a); and (e) transitioning the annular locking ring from the radially compressed state to the relaxed state during (a) to allow the annular locking ring to extend radially partially into the annular recess along the radially inner surface of the receptacle of the cutter element carrier and axially lock the cutter element to the cutter element carrier.

17. The method of claim 16, further comprising:

(f) axially advancing a locking key at an end of the shaft of the cutter element into the locking recess disposed at the closed end of the radially inner surface of the receptacle during (a) to rotationally lock the substrate relative to the cutter element carrier.

18. The method of claim 17, wherein the locking key comprises a plurality of planar flats and the locking recess is defined by a plurality of planar flats, wherein the planar flats of the locking key slidingly engage the planar flats of the locking recess during (f).

19. The method of claim 18, wherein the planar flats of the locking key and the planar flats of the locking recess are oriented parallel to the central axis of the cutter element and the planar flats of the locking recess are oriented parallel to the central axis of the cutter element.

20. The method of claim 16, wherein (d) comprises urging the annular locking ring radially inward with the annular chamfer disposed along the radially inner surface of the receptacle.

21. The method of claim 16, wherein (e) comprises allowing the annular locking ring to radially expand into the annular recess along the receptacle of the cutter element carrier.

22. The method of claim 14, wherein a cylindrical radially outer surface of the shaft slidingly engages the cylindrical surface of the radially inner surface of the receptacle of the receptacle of the cutter element carrier during (a).

* * * * *